US010024134B2

(12) United States Patent
Webster et al.

(10) Patent No.: US 10,024,134 B2
(45) **Date of Patent: *Jul. 17, 2018**

(54) SLIP ASSEMBLY FOR DOWNHOLE TOOLS

(71) Applicant: General Plastics & Composites, L.P., Houston, TX (US)

(72) Inventors: Nicholas Jeffery Webster, Houston, TX (US); Emil Edward Havelka, Houston, TX (US); Edgar Jenaro Martinez, Houston, TX (US)

(73) Assignee: General Plastics & Composites, L.P., Houston, TX (US)

( * ) Notice: Subject to any disclaimer, the term of this patent is extended or adjusted under 35 U.S.C. 154(b) by 181 days.

This patent is subject to a terminal disclaimer.

(21) Appl. No.: 15/171,304

(22) Filed: Jun. 2, 2016

(65) Prior Publication Data

US 2017/0101836 A1 Apr. 13, 2017

Related U.S. Application Data

(60) Provisional application No. 62/239,591, filed on Oct. 9, 2015.

(51) Int. Cl.
*E21B 33/129* (2006.01)
*E21B 33/134* (2006.01)

(52) U.S. Cl.
CPC ..... *E21B 33/1293* (2013.01); *E21B 33/134* (2013.01)

(58) Field of Classification Search
CPC ..... E21B 33/1293; E21B 33/134; E21B 23/01
USPC ..... 166/217, 382
See application file for complete search history.

(56) References Cited

U.S. PATENT DOCUMENTS 6,167,963 B1 * 1/2001 McMahan ..... E21B 33/1204 166/118

OTHER PUBLICATIONS

Office Action dated Jan. 26, 2018 for counterpart U.S. Appl. No. 15/171,300; 8 pages.

* cited by examiner

*Primary Examiner* — Taras P Bemko
(74) *Attorney, Agent, or Firm* — Timothy S. Westby; Porter Hedges LLP

(57) ABSTRACT

A slip assembly for downhole tools comprises a slip ring for engaging a surface of a wellbore and a cone for expanding the slip ring into engagement with the surface of the wellbore. The slip ring has an interior surface defining a trough. The cone has an exterior surface defining a ridge. The ridge is wider than the trough, whereby the slip ring can unbend over a top of the ridge.

16 Claims, 4 Drawing Sheets

SLIP ASSEMBLY FOR DOWNHOLE TOOLS

CROSS-REFERENCE TO RELATED APPLICATIONS

This application claims the benefit under 35 U.S.C. § 119(e) of U.S. Provisional Patent Application No. 62/239,591, filed Oct. 9, 2015, the disclosure of which is hereby incorporated herein by reference in its entirety for all purposes.

STATEMENT REGARDING FEDERALLY SPONSORED RESEARCH OR DEVELOPMENT

Not Applicable.

BACKGROUND

This disclosure relates generally to the oilfield industry and to downhole tools used in wellbores for anchoring tool strings to these wellbores. This disclosure relates more particularly to slip assemblies of such downhole tools, for example slip assemblies of frac plugs, bridge plugs or packers.

Fracing is a process that continues to grow in popularity, as it is known to enhance hydrocarbon production of tight reservoirs. Typically, the fracing process involves the use of frac plugs for isolating a section of the wellbore below or beyond a target zone in order to treat that zone. After setting of the frac plug, fracing fluid is pumped or injected into the target zone at high pressure, resulting in fractures or "cracks" propagating in the formation, and ultimately in valuable hydrocarbons being more easily and abundantly produced through the formation fractures. Once the target zone is treated, the frac plug may be unset, or may be destructed with a drill bit.

Setting frac plugs involves anchoring the frag plugs in the wellbore, typically against an inner wall of a tubular. To anchor a frac plug, a slip assembly including a cone and a slip ring is typically used. The cone may include external fins that are integral to and run axially along the cone. The slip ring may include at least one axial slot, which facilitates subsequent breaking up of the slip ring into individual slip segments. Each slip segment may include a channel that is adapted to mate with an external fin of the cone. As the slip ring traverses the cone, the channels of the slip segments ride on the fins encouraging the slip ring to break apart along the slots into the slip segments. While presenting advantages, these fins often cause additional complications. It is not unusual to see these fins destroyed by the movement of the slips, to have the slip jump over a fin after the first slot breaks, or to have the slots in certain regions remain intact. Also, proper setting of the frac plug relies on the fracturing of numerous weak points and on the movement of the slip segments in unison to achieve a homogeneous contact pressure between the tubular, the fractured ring segments, and the cone. Thus, proper setting is often conditioned by a repeatable break-up of the slip ring.

Thus, there is a continuing need in the art for methods and apparatus for reliably anchoring downhole tools. The features utilized to guide the slip segments are preferably robust. The break-up of the slip ring into ring segments is preferably achieved consistently.

SUMMARY

Herein disclosed is a slip assembly for downhole tools, comprising: a slip ring for engaging a surface of a wellbore, the slip ring having a trough; and a cone for expanding the slip ring into engagement with the surface of the wellbore, the cone having a ridge, the ridge being wider than the through. In an embodiment, the slip ring comprises an interior surface, wherein the interior surface defines the trough; and the cone further comprising an exterior surface, wherein the exterior surface defines the ridge. In an embodiment, the trough having a depth and a span; and the ridge having a height and a base, wherein an aspect ratio of the depth by the span being greater than an aspect ratio of the height by the base.

In an embodiment, the slip assembly comprises a crest surface and two flank surfaces defining the ridge, the crest surface being slanted relative to a longitudinal axis of the slip assembly, the two flank surfaces being oriented at a first angle relative to each other; and a crease surface and two side surfaces defining the trough, the crease surface being slanted relative to the longitudinal axis of the slip assembly, the two side surfaces being oriented at a second angle relative to each other, the first angle being greater than the second angle. In an embodiment, the first angle is obtuse. In an embodiment, the slip assembly comprises a breakable webbed interface for connecting portions of the slip ring, the breakable webbed interface having an aperture; and a splitting fin protruding from one of the two flank surfaces and at least partially into the aperture, the splitting fin having a bevel surface oriented at a third angle relative to the one of the two flank surfaces, the third angle being obtuse.

In an embodiment, the slip assembly comprises a pair of segments at least partially forming the slip ring, the segments of the pair being connected by a flexible webbed interface, the flexible webbed interface being located at a bottom of the trough.

Further disclosed herein is a slip assembly for downhole tools, comprising: a slip ring for engaging a surface of a wellbore, the slip ring having: a plurality of segments joined by webbed interfaces, a cylindrical envelope, wherein the cylindrical envelope has a first radius and a first axis; a plurality of outer cylindrical sectors, each cylindrical sector having a second radius and a second axis, wherein each second axis is decentered with respect to the first axis in a direction away from one of the plurality of webbed interfaces and by a recess distance; and a cone for expanding the slip ring into engagement with the surface of the wellbore. In an embodiment, each second radius is less than a sum of the first radius and the recess distance. In an embodiment, the one of the plurality of webbed interfaces is a breakable webbed interface having at least one aperture and at least one groove formed therein. In an embodiment, the slip ring has an outer surface having a rounded triangular profile. In an embodiment, the slip ring comprises a pair of segments at least partially forming the slip ring, the segments of the pair being connected by a flexible webbed interface; and a breakable webbed interface for connecting portions of the slip ring, the breakable webbed interface having an aperture.

In an embodiment, the cone has an exterior surface, wherein the exterior surface defines a ridge, the ridge having a crest surface and two flank surfaces, the crest surface being slanted relative to a longitudinal axis of the slip assembly, the two flank surfaces being oriented at an obtuse angle relative to each other, a splitting fin protruding from one of the two flank surfaces, the splitting fin having a bevel surface oriented at an obtuse angle relative to the one of the two flank surfaces. In an embodiment, the slip assembly comprises a trough on an interior surface of the slip ring, the trough having a depth and a span, the ridge having a height and a base, an aspect ratio of the depth by the span being greater than an aspect ratio of the height by the base.

Herein discussed is a method of anchoring downhole tools, comprising: providing a slip assembling including a slip ring for engaging a surface of a wellbore and a cone for expanding the slip ring into engagement with the surface of the wellbore, the slip ring including a pair of segments at least partially forming the slip ring, wherein the segments of the pair are connected by a flexible webbed interface; expanding the slip ring toward the surface of the wellbore with the cone; and unbending the segments of the pair at the flexible webbed interface. In an embodiment, the slip ring comprises a breakable webbed interface having a tensile strength lower than the flexible webbed interface, the method further comprising fracturing the breakable webbed interface. In an embodiment, the slip ring comprises a trough, the cone comprises a ridge, the ridge is wider than the trough, the unbending of the segments of the pair comprising the ridge pushing against the trough. In an embodiment, the method further comprises fully contacting a surface of the ridge with a surface of the trough.

These and other embodiments and potential advantages will be apparent in the following detailed description and drawings.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
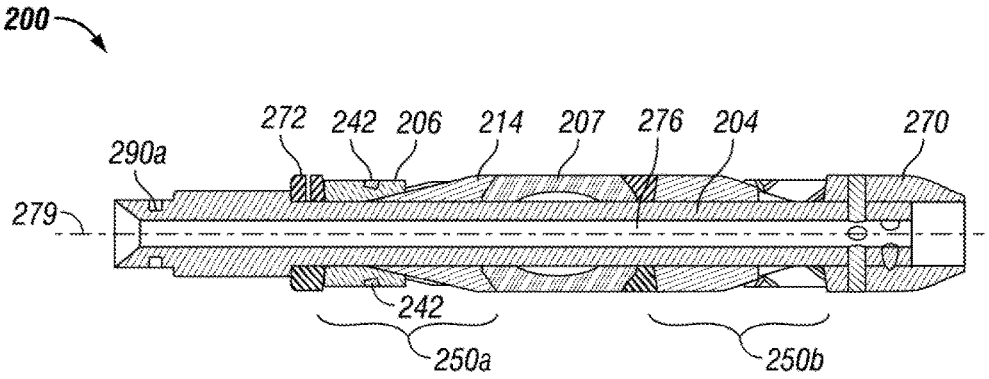
FIG. 1 is a longitudinal sectional view showing a downhole tool having a slip assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

This disclosure describes a slip assembly to anchor a downhole tool to a wellbore surface. The slip assembly comprises a cone having setting ramps to fracture a slip ring into a few portions and to guide the fractured portions into gripping engagement with the wellbore surface. The setting ramps have alternating ridges and splitting fins that may achieve a predictable fracturing of the slip ring and keep the few fractured portions circumferentially aligned. The fractured portions may unbend to achieve a better contact surface and load transfer between the slip ring and the wellbore surface and between the fractured portions and the cone. The slip assembly may be part of a frac plug, bridge plug, packer, or other plugging tool.

A downhole tool 200 that is useable for anchoring a tool string in a wellbore is now described in reference to FIG. 1, which is a sectional view of the downhole tool 200.

A mandrel 204 extends through the entire length of the downhole tool 200. The mandrel 204 may optionally include an axial bore 276 that may provide a flow path for fluids to pass therethrough. The axial bore 276 may include internal components (not shown). For example, the flow path may be selectively sealed using a valve or other obstructing mechanism disposed in the axial bore 276. Further, upper and lower ends of the mandrel 204 may include external components. For example, to facilitate the conveyance of the downhole tool 200 in the wellbore, a setting tool may be coupled to the downhole tool 200 via one or more shear pins inserted into holes provided in an upper end 290A of the mandrel 204. A profiled nose 270 may be secured, also by pins, to a lower end of the mandrel 204. To set the downhole tool 200 in the wellbore, a bearing plate 272 may be disposed about the mandrel 204. An axial downward force applied on the bearing plate 272 may cause the downhole tool 200 to deploy or expand radially and engage a wellbore surface.

To anchor itself in the wellbore, the downhole tool 200 includes one or more slip assemblies 250*a*, 250*b*. In an embodiment, the downhole tool 200 may be uni-directionally anchored, in the sense that only one slip assembly 250*a* or 250*b* may prevent the tool from moving as a result of an over pressure applied against one side of the tool. In another embodiment, the downhole tool 200 may be bi-directionally anchored, in the sense that two slip assemblies 250*a* and 250*b* may prevent the tool from moving as a result of an over pressure applied against any one of both sides of the tool, that is, from either above and below the tool. For example, slip assemblies 250*a* and 250*b* may be symmetrical from one another (i.e. one is similar to the other after flipping). However, slip assemblies 250*a* and 250*b* may not need to be symmetrical. As shown, slip assemblies 250*a* and 250*b* are not angularly aligned along the longitudinal axis of the tool, and thus are not completely symmetrical.

The slip assembly 250*a* (or 250*b*) includes a slip ring 206 disposed about the mandrel 204. The slip ring 206 may be of a one-piece configuration, the ring however having partial apertures machined therein. The slip assembly 250*a* also includes a cone 214 disposed about the mandrel 204. An end of the cone 214 is sized to wedge between a radially inward surface of the slip ring 206 and an outer surface of the mandrel 204. To anchor the downhole tool 200 in the wellbore, the slip ring 206 is configured to expand toward a wellbore surface, such as an inner wall of a tubular, and to engage the surface. For example, by applying force against the slip ring, the cone 214 may fracture the slip ring 206 into segments that are then pushed toward the inner wall of the tubular. The partial apertures in the slip ring may be sized to facilitate fracturing of the ring in a few segments that may optionally, but not necessarily, be essentially identical. During expansion, the segments may remain axially aligned because they all abut a shoulder of the bearing plate 272 (or a shoulder of the profiled nose 270 for the slip assembly 250*b*) and may also remain circumferentially aligned because they all slide against ridges provided on the cone 214.

To grip against the inner wall of a tubular or other wellbore surface, inserts 242 (or alternatively, serrated surfaces or teeth) are configured to bite into the inner wall of the tubular, and may prevent the slip assembly 250*a*, 250*b*, or the downhole tool 200, from moving axially or longitudinally within the wellbore. Without sufficient bite, the downhole tool 200 may inadvertently release or move from its anchored position. For example, the inserts 242 may have an edge, corner, surface, or other shape that is suitable for gripping against the inner surface. The inserts 242 may be made of mild steel, such as 1018 heat treated steel, sintered carbide steel grid, or other suitable material.

The anchored position of the downhole tool 200 may be maintained by holding potential energy of compressed resilient components of the tool. To release the downhole tool 200 from its anchored position, the slip assemblies may be destructed with a drill bit. Thus, most components of the tool components may be made of drillable material, such as composites comprising glass fibers and polymerized resin. For example, at least one component of the slip assembly 250*a* (or 250*b*) may have been made by wet winding one or more fibers having a phase angle in a range from about 0 degrees to about 90 degrees relative to a longitudinal axis of the downhole tool 200, and preferably in the range from about 30 degrees to about 70 degrees.

In some embodiments, the downhole tool 200 may be configured as a frac plug, bridge plug, packer, or the like, so that fluid pressure can be increased in a portion of the wellbore near a target zone while isolating another portion of the wellbore. The tool may be configured by utilizing one of a plurality of adapters or other optional components as would generally be known to one of skill in the art. For example, a seal element 207 may provide a fluid-tight seal by compressing against the tubular surface. The seal element 207 may be a conventional seal element configured to deform radially when compressed axially during the setting of the downhole tool 200.

Figure 2:
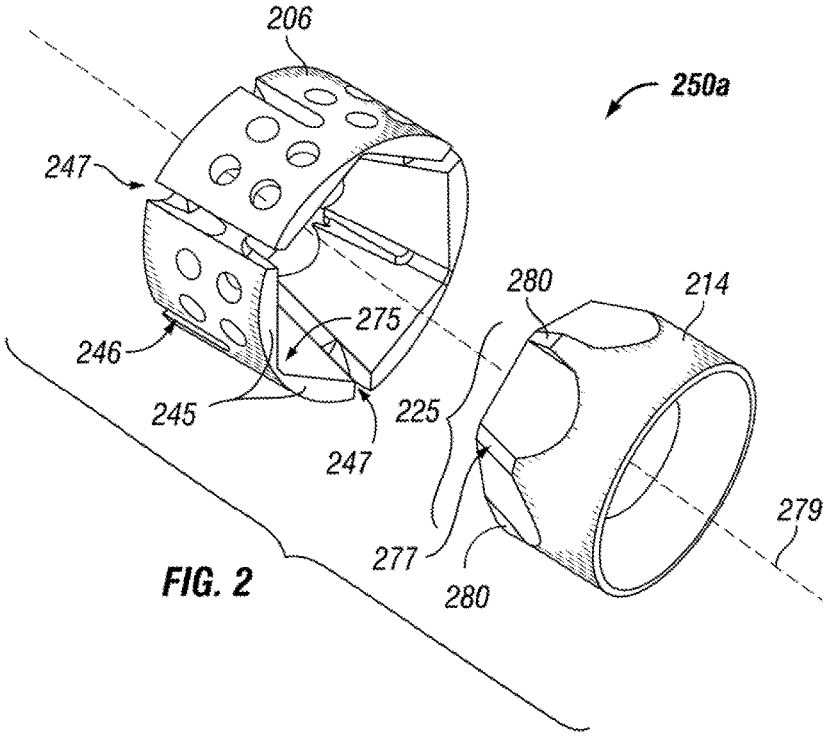
FIG. 2 is an exploded view showing components of a slip assembly.

Examples of components of the slip assembly 250*a* (or 250*b*) are now described in reference to FIG. 2, which is a perspective view showing the slip ring 206 and of the cone 214 separated along a common longitudinal axis 279.

The slip ring 206 comprises segment pairs 245, the segments in each pair being connected via a flexible webbed interface 246 spanning between the two segments in the pair. In the example shown in FIG. 2, the slip ring has 3 segment pairs distributed in 3 angular sectors of 120°. Any segment pair 245 is coupled to 2 adjacent segment pairs 245 by a breakable webbed interface 247. Similarly, the cone 214 has 3 setting ramps 225 distributed in 3 angular sectors of 120°. Each setting ramp 225 may correspond to, and align with, a segment pair 245.

Each setting ramp 225 is configured to guide the corresponding pair 245 of slip segments into gripping engagement with a surface in a wellbore. As such, each of the setting ramp 225 comprises a ridge 277 configured to slide in a corresponding trough 275 on one of the segment pairs 245 and push the segment pair 245 radially outward. In addition, each setting ramp 225 may be surrounded by 2 splitting fins 280 corresponding to, and aligned with, 2 breakable webbed interfaces 247.

The ridges 277 and the troughs 275 are slanted with respect to the common longitudinal axis 279. The slant angle may be referred to as the expansion angle, and may be about 20.2° for example. The expansion angle may be selected sufficiently shallow to insure sufficient friction between the slip ring 206 and the cone 214 when the slip segments are compressed between the cone 214 and the wellbore surface. The expansion angle may also be selected based on the expansion distance to be traveled by the slip ring 206 prior to engagement with the wellbore surface and the overall length desired for the slip assembly 250*a*

Figure 3A:
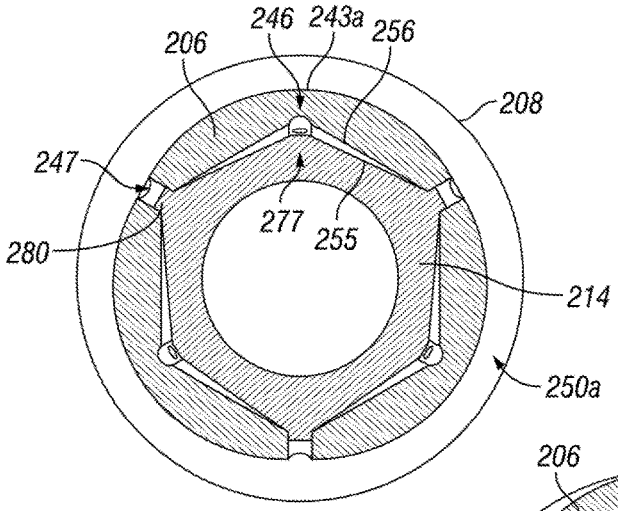
FIG. 3A is a cross longitudinal sectional view a cone and a slip ring before setting in a tubular.
Figure 3B:
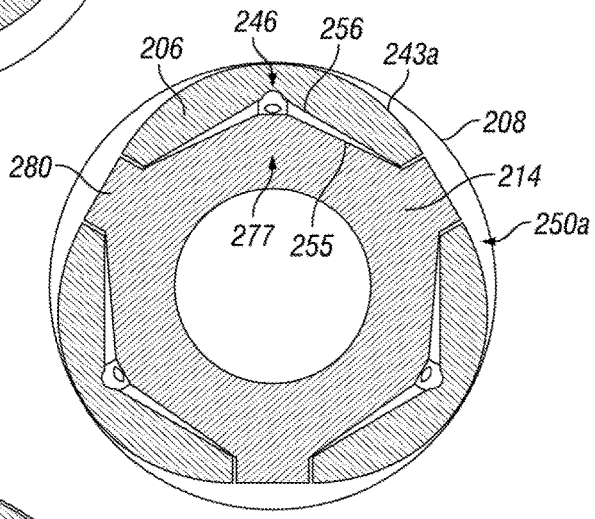
FIG. 3B is another cross longitudinal sectional view a cone and a slip ring before setting in a tubular.
Figure 4:
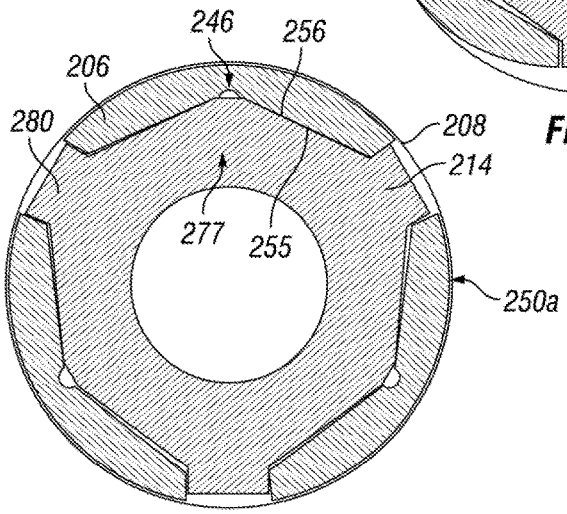
FIG. 4 cross longitudinal sectional view a cone and a slip ring after setting in a tubular.

A setting operation of the downhole tool 200 is now described in reference to FIGS. 3A, 3B, and 4, which are cross longitudinal sectional views of the slip assembly 250*a*, respectively in initial, intermediary, and set configurations. In this example, the slip assembly 250*a* sets against an inner wall of a tubular 208, an example of a wellbore surface the slip assembly 250*a* may anchor against. Compared to the initial configuration, a penetration of the cone 214 into the slip ring 206 is larger in the intermediary configuration, and the largest in the set configuration, and therefore the cone 214 progressively fills a cross sectional area that is larger in FIG. 4 than in FIG. 3B, and FIG. 3A.

A radius of curvature of an outer surface 243*a* of each segment pair may be less than the radius of the inner wall of the tubular 208 to anchor against, therefore requiring the flexible webbed interface 246 to unbend in order to conform the curvature of the outer surface 243*a* to the curvature of the inner wall. Unbending of the segments pairs may promote a homogeneous contact pressure between each segment pair and the inner wall after expansion of the slip ring 206.

To permit unbending for the segment pairs to conform to the inner wall of the tubular 208, the flexible webbed interfaces 246 are made sufficiently deformable. In addition, the flexible webbed interfaces 246 assist the segment pairs in straddling the ridges 277 of the setting ramps, and/or assist the ridges 277 in applying a setting force evenly to both segments in each segment pair. As further explained below, the webbed interfaces 246 may be made increasingly flexible by machining one or more apertures into the slip ring 206 at the location of the flexible webbed interfaces 246.

During setting, the flanks of the ridge 277 of each setting ramp push against the sides of the trough 275 of a corresponding segment pair, forcing the segment pair to unbend at the level of the flexible webbed interface 246. After unbending, an outer surface 255 of the cone 214 may come into full contact with an inner surface 256 of the slip ring 206, insuring good load transfer between the segment pairs of slip ring 206 and the setting ramps of the cone 214, and between the segment pairs of the slip ring 206 and the inner wall of the tubular 208.

Note also that each of the splitting fins 280 may protrude at least partially within an aperture of a breakable webbed interface 247. Because the splitting fins 280 flare out as the slip ring 206 travels on the cone 214, the splitting fins 280 preferentially apply a tension to links in the breakable webbed interfaces 247, facilitating consistent fracturing of the slip ring 206 into a few portions (i.e., a few segment pairs). Thus, the splitting fins 280 may increase the tension applied to the breakable interfaces 247, and may also limit the tension applied to the flexible interfaces 246.

Figure 5:
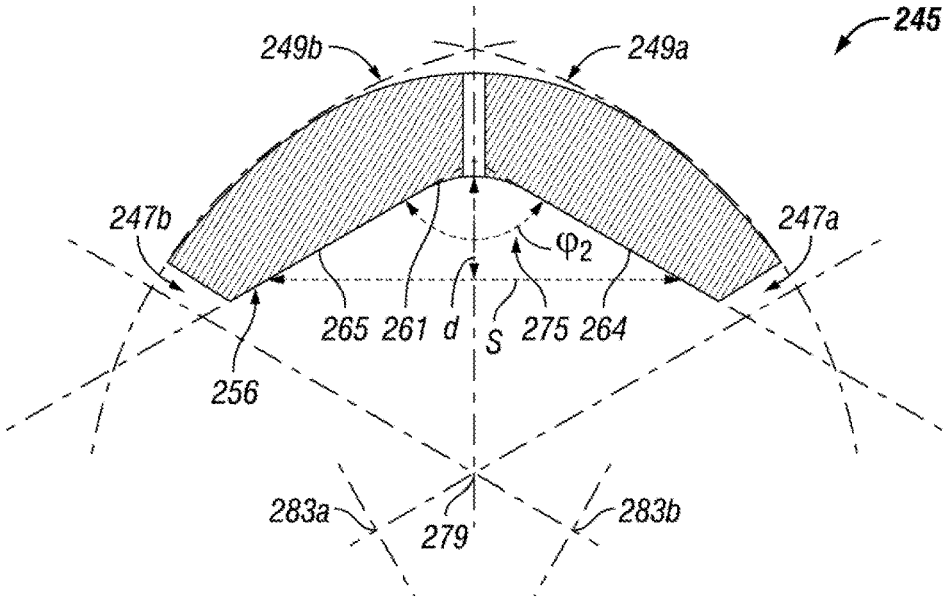
FIG. 5 is a cross longitudinal sectional view a portion of a slip ring.

An example shape of a segment pair 245 is now described in reference to FIG. 5, which is a sectional view of the segment pair 245.

A first segment in the pair 245 may be made by forming an outer cylindrical sector 249*a* that is decentered with respect to the common longitudinal axis 279. For example, a second axis of curvature 283*a* of the outer cylindrical sector 249*a* may be recessed from the first longitudinal axis 279—the common longitudinal axis also shown in FIG. 2—in a direction away from the location of the breakable webbed interface 247*a*. The recess distance may be about 0.366 inches. The outer cylindrical sector 249*a* is also less curved than a cylindrical envelope of the slip ring (see for example the cylindrical envelope 248 in FIG. 7). Thus, the first segment in the pair 245 is the thinnest at the locations of the breakable webbed interfaces 247*a* and the thickest at the locations of the flexible webbed interfaces 246. For example, a radius of curvature of the outer cylindrical sector 249*a*—referred to as the second radius—may be increased from a radius of curvature of the cylindrical envelope of the slip ring—referred to as the first radius—by an amount that is less than the recess distance—for example by about 0.208 inches. In other words, the second radius is less than the sum of the first radius and the recess distance. A second segment in the pair may be symmetrically made by forming an outer cylindrical sector 249*b* having a second axis of curvature 283*b* recessed from the first longitudinal axis 279 in a direction away from the location of the breakable webbed interface 247*b*.

As further discussed below, the through 275 is narrower than a corresponding ridge 277 (in FIG. 6) on the cone, for the segment pair 245 to unbend upon setting against the wellbore surface. Thus, the trough 275 may have an aspect ratio of a depth by a span that is greater than an aspect ratio of the ridge 277. The aspect ratio of the trough is determined, for example, by selecting a span s above the through 275, measuring a corresponding depth d of the trough 275 below the selected span, and computing the ratio of the depth d divided by the span s.

In the example embodiment of FIG. 5, the inner surface 256, which defines the trough 275, is made of portions of a plurality of elementary surfaces. That is, the trough 275 comprises a crease surface 261, which may be a portion of a cylindrical surface, and by two side surfaces 264 and 265, which may be portions of planar surfaces. The two side surfaces 264 and 265 are oriented at an angle φ2 with respect to each other. This angle φ2 is preferably obtuse. Further, because the trough 275 is narrower than the corresponding ridge 277, this second angle φ2 is less than a first angle φ1 (in FIG. 6) that quantifies the orientation between two flank surfaces of the ridge 277.

Figure 6:
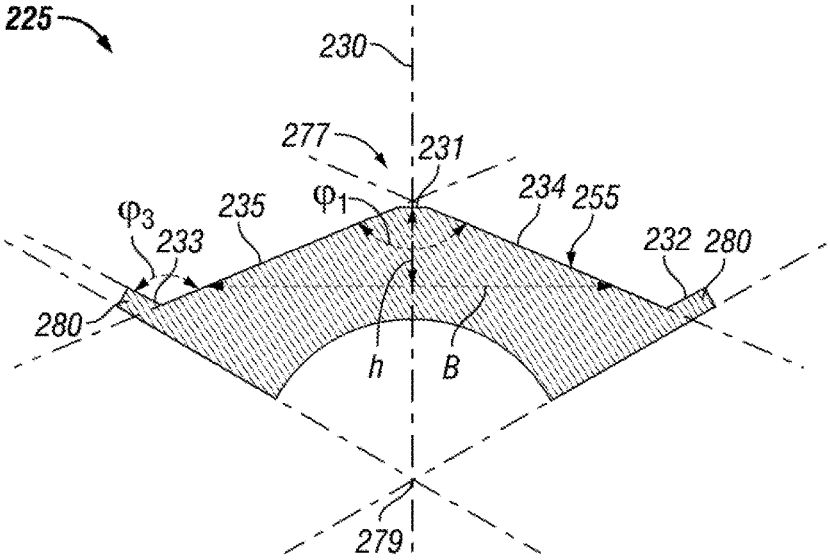
FIG. 6 is a cross longitudinal sectional view of a portion of a cone.

An example shape of setting ramp 225 is now described in reference to FIG. 6 that is a sectional view of the setting ramp 225.

The cone comprises the exterior surface 255 defining the ridge 277. As mentioned earlier, the ridge 277 is wider than the corresponding trough 275 (in FIG. 5) on the slip ring. Thus, the ridge 277 may have an aspect ratio of a height by a base that is less than the aspect ratio of the trough 275. The aspect ratio of the ridge is determined for example by selecting a base B below the ridge 277, measuring a corresponding height of the ridge 277 above the selected base, and computing the ratio of the height h divided by the base B.

In the example embodiment of FIG. 6, the exterior surface 255, which defines the ridge 277, is made of portions of a plurality of elementary surfaces. That is, the ridge 277 comprises a crest surface 231, which may be a portion of a cylindrical surface, and by two planar flank surfaces 234 and 235, which may be portions of planar surfaces. The two flank surfaces 234 and 235 are oriented at an angle φ1 with respect to each other. This angle φ1 is preferably obtuse too. Further, because the ridge 277 is wider than the corresponding trough 275 (in FIG. 5), this first angle φ1 is greater than the second angle φ2 (in FIG. 5) that quantifies the orientation between two side surfaces 264 and 265 of the trough 275.

As shown in this example, the splitting fins 280 protrude from both of the flank surfaces 234 or 235, and are partially defined by bevel surfaces 232 or 233. The 2 bevel surfaces 232 and 233 may be symmetric with respect to the longitudinal half-plane 230 of the cone. Each of the 2 bevel surfaces 232 and 233 may be flat and angled with respect to the flank surfaces 234 and 235 by an obtuse reentrant angle φ3—for example by about −120 degrees. The bevel surfaces 232 and 233 define additional guiding surfaces of the setting ramp 225. Because the reentrant angle is obtuse, the bevel surfaces 232 and 233 may be comparatively more resistant to damage caused by erratic movement of a segment pair than a usual fin.

The slip ring 206 comprises a slip body 240. The body 240 is preferably made of drillable material, for example glass fibers impregnated by polymerized resin. Details of the slip ring 206 and of an example method of making it are now described in reference to FIGS. 7, 8, and 9.

The slip ring 206 may be made from a hollow cylinder by lathing and then milling. The slip body 240 comprises an outer surface 243*a*, a front face 243*b*, and a back face 243*c*. The outer surface 243*a*, further defined below, may fit within a cylindrical envelope 248 of about 3.685 inches. The slip body 240 comprises an inner bore 241 aligned with the common longitudinal axis 279. The diameter of the inner bore 241 may be about 2.02 inches, and is sized for holding the slip ring 206 around the mandrel 204 (in FIG. 1) before expansion. The length between the front and back faces, respectively 243*b* and 243*c*, may be about 1.950 inches. The slip ring 206 comprises at least 2 segment pairs 245, preferably 3, and optionally more than 3.

Figure 7:
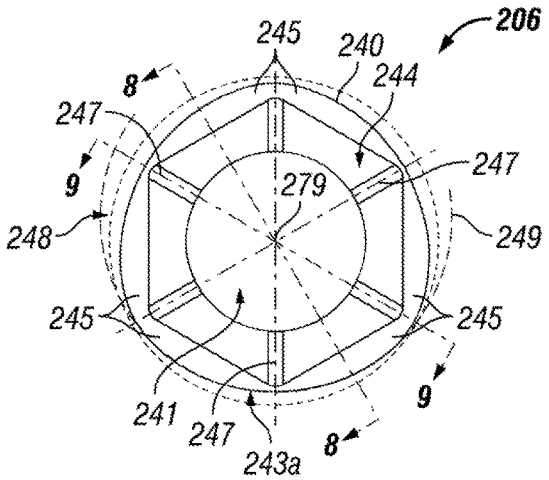
FIG. 7 is cross longitudinal plan view of a slip ring.

Details of the outer surface 243*a* of the slip body 240 are now described in reference to FIG. 7 in particular, which is a cross longitudinal plan view of the slip ring 206. Note that for the sake of clarity, details of the webbed interfaces 246, 247, as well as details of the inserts 242 (in FIG. 1) have been omitted in FIG. 7.

The profile of the outer surface 243*a* may be described as rounded triangular. It may be obtained by machining three curved side surfaces out of a cylinder lathe defined by the cylindrical envelope 248, shown in dashed line in FIG. 7. Each side surface is a cylindrical sector 249 similar to the cylindrical sectors 249*a*, 249*b* shown in FIG. 5.

Figure 8:
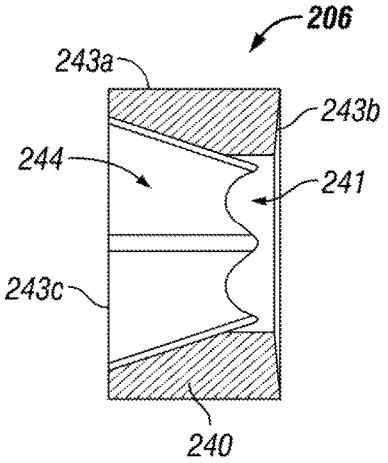
FIG. 8 is a longitudinal sectional view of the slip ring shown in FIG. 7.

Details of an inner surface of the slip body 240 are now described in reference to FIG. 7 as well as FIG. 8, which is a longitudinal sectional view of the slip ring shown in FIG. 7. Note that for the sake of clarity, details of the webbed interfaces 246, 247, as well as details of the inserts 242 have again been omitted in FIGS. 7 and 8.

A right pyramidal volume 244 having filleted edges is cut into the slip body 240 from the back face 243*c* of the slip ring. The base of the pyramidal volume is regular hexagonal and the axis of the pyramidal volume is aligned with the longitudinal axis of the mandrel. The slant angle of the edges of the pyramidal volume relative to the longitudinal axis is the expansion angle discussed above, and may thus be about 20.2° for example. The slant angle of the faces of the pyramidal volume relative to the longitudinal axis may about 17.65°, and corresponds to a slant angle of the edges of about 20.2° for a pyramid with a hexagonal base. The volume 244 may be large enough to insure that the cone can be inserted into the ring slip a sufficient distance before contacting the slip—for example, the insertion distance may be about 10% of the ring slip axial length. In this example, the distance between two opposite sides of the hexagonal base may be about 1.842 inch.

Each corner of the pyramidal volume 244 cut into the slip body 240 form the troughs 275. Thus, the crease surface 261 (in FIG. 5) may correspond to the filleted edges of the pyramidal volume 244, and two side surfaces 264 and 265 (in FIG. 5) may correspond to two adjacent faces of the pyramidal volume sharing the same edge. Further, the base of the pyramidal volume being hexagonal, the two side surfaces 264 and 265 are oriented at the obtuse angle φ2 (in FIG. 5) of 120°.

While the shown example utilizes a pyramidal volume having a regular hexagonal base and filleted edges that is cut into the slip body 240 to form a plurality of troughs in an interior surface of the body, other volume shapes may be used. Thus, in other embodiments, the side surfaces of the trough may be curved and not flat. The crease surface may be reduced to a line, for example when the edges of the pyramidal volume are sharp and not filleted. The side surfaces may be oriented at an angle different from 120° is the base of the pyramidal volume is octagonal or decagonal, preferably, but not exclusively, at an obtuse angle. Also, the base of the pyramidal volume may not be regular, and some troughs may have aspect ratios different from each other.

The front face 243*b* may include a shallow inward tapered cone—for example by about 5 degrees—for facilitating sliding of the slip ring segments against the bearing plate 272 (in FIG. 1) and/or the profiled nose 270 (in FIG. 1) during expansion.

Figure 9:
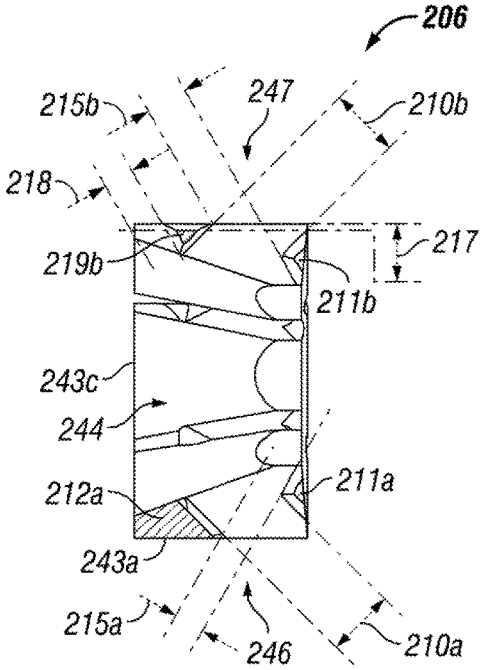
FIG. 9 is another longitudinal sectional view of the slip ring shown in FIG. 7.

Details of the apertures made in the flexible webbed interface 246 and in the breakable webbed interface 247 are now described in reference to FIG. 9, which is a longitudinal sectional view of the slip ring shown in FIG. 7.

For example a middle aperture 210*a* having an oblong cross section with a width of about 0.250 inch and a length of about 0.780 inch may be cut from the outer surface 243*a*, through the slip body 240, and inward to the surfaces of the pyramidal volume 244. The middle aperture 210*a* may be inclined by an acute angle relative to the slip back face 243*c*—for example pointing by about 45 degrees towards the back face—and may be cut at an offset towards the front face of the slip ring 206—for example penetrating the outer surface 243*a* essentially in the front half of the length of the slip ring. The middle aperture 210*a* may separate a front web portion from a back web portion.

In the back web portion, the middle aperture 210*a* leaves at least one thin but relatively long link between the segments of the pair 245 that resist tension and that is relatively compliant to bending. Thus, the flexible webbed interface 246 comprises a back link 212*a*.

Note that the flexible webbed interface 246 may include additional links, and that the additional links may be sized to break. For example, the flexible webbed interface 246 may include a front link 211*a* located in the front web portion. The front link 211*a* is made by further machining a front aperture 215*a* having an oblong cross section with a width of about 0.250 inch and a length of about 0.350 inch that may be cut from the outer surface 243*a*, through the slip body 240, and inward to the inner bore 241. The front aperture 215*a* may be inclined by an acute angle relative to the slip back face 243*c*—for example pointing by about 30 degrees towards the front face 243*b*—and may be cut to form an X with the middle aperture 210*a*. Thus the front link 211*a* may be located near the front face 243*b*, somewhere midway in the thickness of the slip ring 206 between the inner bore 241 and the outer surface 243*a*.

The breakable webbed interface 247 may be made by machining cuts or grooves in addition to apertures 210*b* and 215*b* similar to the apertures 210*a* and 215*a* machined to make the flexible webbed interface 246. For example, the breakable webbed interface 247 may be made by adding a cut 217 in the form of a shallow groove along the entire length of the outer surface 243*a* of the slip ring 206. A back aperture 218 having an oblong cross section with a width of about 0.250 inch and a length of about 0.315 inch may additionally be machined from the outer surface 243*a*, through the slip body 240, and inward to the surfaces of the pyramidal volume 244. The back aperture 218 may be inclined by an acute angle relative to the slip back face 243*c*—for example pointing by about 30 degrees towards the front face 243*b*—and may be drilled starting at the back face 243*c* of the slip and penetrating the outer surface 243*a*. The 3 apertures 210*b*, 217 and 218 define a back link 219*b* therebetween. Thus, the breakable webbed interface 247 has a tensile strength that is lower—for example 33% lower—than the tensile strength of the flexible webbed interface 246. Also, as the cone 214 wedges between a radially inward surface of the slip ring 206 and an outer surface of the mandrel 204, the back link 219*b* of each breakable webbed interface 247 may break, permitting the segment pairs 245 to flare while remaining secured to the mandrel 204 front links 211*b*. The front link 211*b* may break after further compression of the cone 214 against the slip ring 206, permitting radial expansion of the segments pairs 245.

It should be noted that the present disclosure describe particular methods of manufacturing the components of a slip assembly. Those skilled in the art, given the benefit of the present disclosure, will realize that other manufacturing methods may alternatively be used. For example, the components of the slip assembly may be made by molding, or 3d printing.

Further, the present disclosure describes certain dimensions of the slip components. Those skilled in the art, given the benefit of the present disclosure, will realize that other embodiments may have different dimensions, either uniformly scaled or not, that are equally functional. Only a few proportions may need to remain within restrictive limits.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A slip assembly for downhole tools, comprising:

a slip ring for engaging a surface of a wellbore, the slip ring having a trough;

a cone for expanding the slip ring into engagement with the surface of the wellbore, the cone having a ridge, the ridge being wider than the trough;

a crest surface and two flank surfaces defining the ridge, the crest surface being slanted relative to a longitudinal axis of the slip assembly, the two flank surfaces being oriented at a first angle relative to each other; and a crease surface and two side surfaces defining the trough, the crease surface being slanted relative to the longitudinal axis of the slip assembly, the two side surfaces being oriented at a second angle relative to each other, the first angle being greater than the second angle.

2. The slip assembly of claim 1, the slip ring comprising an interior surface, wherein the interior surface defines the trough; and the cone further comprising an exterior surface, wherein the exterior surface defines the ridge.

3. The slip assembly of claim 1, the trough having a depth and a span; and the ridge having a height and a base, wherein an aspect ratio of the depth by the span being greater than an aspect ratio of the height by the base.

4. The slip assembly of claim 1 wherein the first angle is obtuse.

5. The slip assembly of claim 1, comprising:

a breakable webbed interface for connecting portions of the slip ring, the breakable webbed interface having an aperture; and a splitting fin protruding from one of the two flank surfaces and at least partially into the aperture, the splitting fin having a bevel surface oriented at a third angle relative to the one of the two flank surfaces, the third angle being obtuse.

6. The slip assembly of claim 1, comprising:

a pair of segments at least partially forming the slip ring, the segments of the pair being connected by a flexible webbed interface, the flexible webbed interface being located at a bottom of the trough.

7. A slip assembly for downhole tools, comprising:

a slip ring for engaging a surface of a wellbore, the slip ring having:

a plurality of segments joined by webbed interfaces, a cylindrical envelope, wherein the cylindrical envelope has a first radius and a first axis;

a plurality of outer cylindrical sectors, each cylindrical sector having a second radius and a second axis, wherein each second axis is decentered with respect to the first axis in a direction away from one of the plurality of webbed interfaces and by a recess distance; and a cone for expanding the slip ring into engagement with the surface of the wellbore;

wherein the cone has an exterior surface, wherein the exterior surface defines a ridge, the ridge having a crest surface and two flank surfaces, the crest surface being slanted relative to a longitudinal axis of the slip assembly, the two flank surfaces being oriented at an obtuse angle relative to each other, a splitting fin protruding from one of the two flank surfaces, the splitting fin having a bevel surface oriented at an obtuse angle relative to the one of the two flank surfaces.

8. The slip assembly of claim 7 wherein each second radius is less than a sum of the first radius and the recess distance.

9. The slip assembly of claim 7 wherein the one of the plurality of webbed interfaces is a breakable webbed interface having at least one aperture and at least one groove formed therein.

10. The slip assembly of claim 7 wherein the slip ring has an outer surface having a rounded triangular profile.

11. The slip assembly of claim 7 wherein the slip ring comprises:

a pair of segments at least partially forming the slip ring, the segments of the pair being connected by a flexible webbed interface; and a breakable webbed interface for connecting portions of the slip ring, the breakable webbed interface having an aperture.

12. The slip assembly of claim 7, comprising:

a trough on an interior surface of the slip ring, the trough having a depth and a span, the ridge having a height and a base, an aspect ratio of the depth by the span being greater than an aspect ratio of the height by the base.

13. A method of anchoring downhole tools, comprising:

providing a slip assembly including a slip ring having a trough for engaging a surface of a wellbore and a cone for expanding the slip ring into engagement with the surface of the wellbore, a crest surface and two flank surfaces defining the ridge, the crest surface being slanted relative to a longitudinal axis of the slip assembly, the two flank surfaces being oriented at a first angle relative to each other; and a crease surface and two side surfaces defining the trough, the crease surface being slanted relative to the longitudinal axis of the slip assembly, the two side surfaces being oriented at a second angle relative to each other, the first angle being greater than the second angle;

the slip ring including a pair of segments at least partially forming the slip ring, wherein the segments of the pair are connected by a flexible webbed interface;

expanding the slip ring toward the surface of the wellbore with the cone; and unbending the segments of the pair at the flexible webbed interface.

14. The method of claim 13, wherein the slip ring comprises a breakable webbed interface having a tensile strength lower than the flexible webbed interface, the method further comprising fracturing the breakable webbed interface.

15. The method of claim 13 wherein the cone comprises a ridge, wherein the ridge is wider than the trough, and wherein the unbending of the segments of the pair comprising the ridge pushing against the trough.

16. The method of claim 15 further comprising fully contacting a surface of the ridge with a surface of the trough.

* * * * *